United States Patent [19]

Schmachtel et al.

[11] 4,084,390

[45] Apr. 18, 1978

[54] APPARATUS FOR PACKAGING BULK MATERIAL

[75] Inventors: Florian Schmachtel, Grossen-Linden; Heinrich Müeller, Lindenstruth, both of Germany

[73] Assignee: Rovema Verpackungsmaschinen GmbH & Co. KG., Giessen, Germany

[21] Appl. No.: 783,956

[22] Filed: Apr. 1, 1977

[30] Foreign Application Priority Data

Apr. 8, 1976 Germany ..... 2615270

[51] Int. Cl.[2] ..... B65B 31/04

[52] U.S. Cl. ..... 53/112 A; 53/171; 141/65; 141/77

[58] Field of Search ..... 53/22 R, 22 A, 112 R, 53/112 A, 171; 141/7, 65, 77

[56] References Cited

U.S. PATENT DOCUMENTS

| | | | |
|---|---|---|---|
| 2,138,356 | 11/1938 | Ryan et al. | 141/7 |
| 3,488,915 | 1/1970 | Delestatius | 53/112 A |
| 3,518,809 | 7/1970 | Ott | 53/112 A |
| 3,724,163 | 4/1973 | Roussel | 53/171 |

FOREIGN PATENT DOCUMENTS

| | | | |
|---|---|---|---|
| 1,265,801 | 3/1972 | United Kingdom | 141/7 |

*Primary Examiner*—Travis S. McGehee
*Attorney, Agent, or Firm*—Blanchard, Flynn, Thiel, Boutell & Tanis

[57] ABSTRACT

A method and apparatus for packing of bulk materials. The bulk material is measured in portions and dispensed into a fill pipe. Suction probes are provided for evacuating the entrapped gas from the bulk material while in the fill pipe. The fill pipe is then lowered against a stop to suddenly jar the fill pipe to effect a release of the gas-free bulk material into a tubelike container. Thereafter, the top of the tubelike container is sealed closed and lowered into a bag and delivered to a station whereat the bag is sewn closed.

18 Claims, 6 Drawing Figures

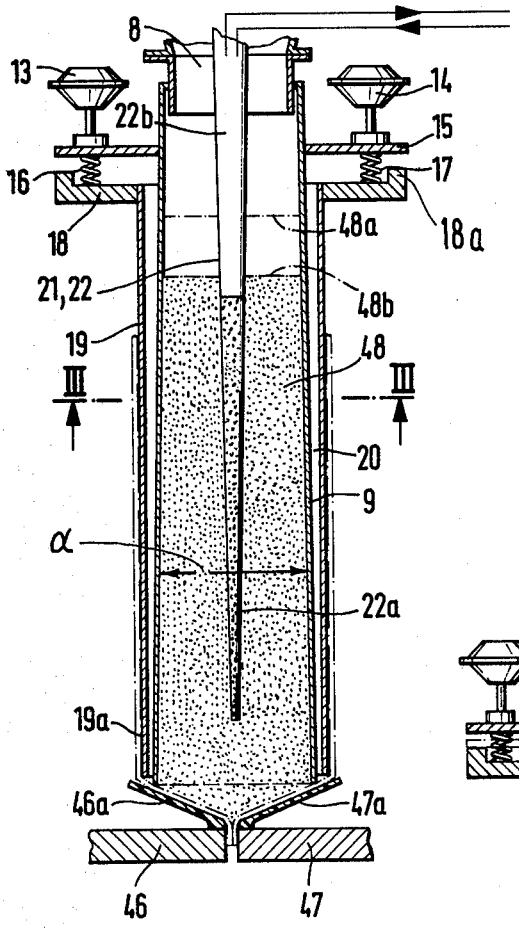
FIG. 2
FIG. 3
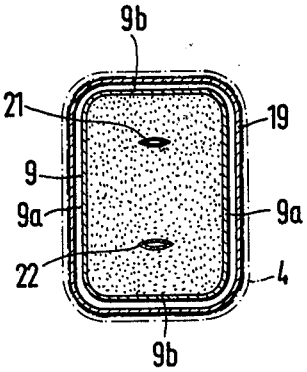
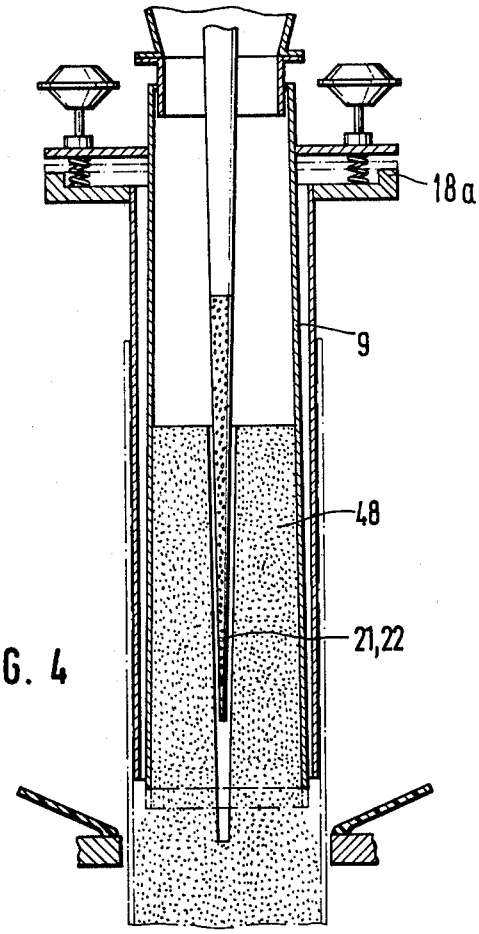
FIG. 4

APPARATUS FOR PACKAGING BULK MATERIAL

FIELD OF THE INVENTION

The invention relates to a method and an apparatus for packing bulk materials, in particular powdery bulk materials, wherein the bulk material is measured in portions and entrapped gas, in particular air, is evacuated from the individual portions.

BACKGROUND OF THE INVENTION

During packaging of bulk materials, it is often necessary, to remove at least partly the air which is entrapped between the material particles to thus achieve a sufficient filling of the packing container, especially if earlier for producing a better flow capability of the bulk material air was purposefully introduced into said bulk material. A certain amount of air evacuation can be achieved by leaving the container, for example a bag, open for some minutes after having been filled. When the bulk material settles, the air which exists between the particles is partially removed and escapes upwardly. This method has the disadvantage that the station time within a filling plant must either be held very long or that sufficient space must be provided for the containers which are in the stage after filling, however, prior to closing. Furthermore, devices for the slow further transport of these not as yet closed containers are needed.

To speed up air evacuation, one has also already applied the abovementioned method in which suction probes having an air-permeable surface are introduced into the bulk material (British Pat. No. 965 321, French Pat. No. 1,327,946). The bulk material is thereby already in a packing container, namely a bag. It is true that with this method the air evacuating time can be reduced to a few seconds, however, the packing container must be chosen so large that the measured bulk material portion finds room therein also in the not as yet evacuated condition. After the air evacuation process, the container is then in most cases slightly too large. This means a greater use of packing material than would be necessary in order to pack the air-evacuated portion.

The basic purpose of the invention is to provide a method which permits a designing of the packing container only to the size which is needed for packaging the air-evacuated bulk material portion. Furthermore the invention includes an apparatus for carrying out the method.

The inventive method of the abovementioned type is characterized by a portion of bulk material being filled into a fill pipe during each filling operation, by the gas being evacuated during the stay of the bulk material in the fill pipe and by the portion being thereafter ejected from the fill pipe and being filled into a packing container, preferably a tubelike bag.

Since in the case of the inventive method the air evacuation (or possibly also the evacuation of a different gas) is done prior to the bulk material portion being filled into the packing container, the volume of the portion is during filling into the packing container already as small as it can be after the air evacuation. It is therefore sufficient to provide a packing container which can receive the air-evacuated portion. Thus the size of the container is not chosen, as this is the case in the known method, with consideration of the volume prior to the air evacuation. From this results a substantial saving in packing material.

The further development of the method wherein the container is sealed shut after the evacuation process achieves a further reduction of the air content. This is not supposed to cover primarily air, which is between the particles of the bulk material, but air, which for example is at the upper end of the packing container or possibly in cavities which are created during the pulling out of suction probes. A desired shape of the package and a yet better compactness is achieved with the further development by pressing or compressing the container.

The apparatus embodying the invention has the advantage compared with known devices that operating mechanisms for the suction probes are not needed which brings about a substantial reduction in cost.

A conical construction of the fill pipe has the advantage that the bulk material can be ejected particularly easily from the fill pipe. One must consider that some bulk materials, in particular powdery bulk materials, are compacted to a compact block due to air evacuation so that ejection from the fill pipe is equivalent to a mold release operation.

Fill pipe shapes with an approximately rectangular cross section approximately equal to the cross section of the packing container are particularly advantageous because the bulk material takes on the shape of the packing container already in the fill pipe.

The embodiment having an outer pipe which surrounds the fill pipe is particularly well suited if an additional evacuation after a filling of the bulk material into the packing container is to take place.

An operating mechanism for the fill pipe which is movable in a direction parallel to its axis eases ejection of the bulk material because with the aid of such a mechanism the bulk material is so to speak beaten out of the fill pipe, namely it tears loose from the fill pipe due to its motion energy (momentum) when said fill pipe is suddenly stoppd by a stop.

The inventive apparatus can be constructed as a pure filling device wherein prefabricated packing containers can be supplied in any manner. The packing containers can thereby be both fixed containers, as for example cans, and also flexible containers, thus sacks or bags. According to a further development of the invention, however, the apparatus is combined with a flexible tube bagging machine wherein the fill pipe is at the same time the fill pipe of the flexible tube bagging machine and the lower end of which can be closed off by compressing the casing-material tube by means of cross seal jaws of the flexible tube bagging machine. In this version, in one single aggregate both the manufacture of the packing container, namely the tubelike bag, is effected and also air evacuation and filling of the bulk material into the packing container. In the combination of the apparatus with a flexible tube bagging machine, the already mentioned outer pipe is surrounded by a shaping shoulder for shaping a casing-material tube from a casing-material sheet.

The flat design of the probes has the advantage that only relatively small cavities remain in the bulk material when the bulk material is pulled off from the suction probes. In spite of this, however, one obtains the desired large contact surface between bulk material and the probes. Tapering of the probe eases again ejection of the bulk material from the fill pipe, thus it has a similar function as the already mentioned tapering of the fill pipe.

Through the probe arrangement, the cross section of a rectangularly shaped fill pipe is particularly well engaged and thus an effective air evacuation is achieved in a short time.

The sintered construction of the suction probe has the advantage that the suction openings are small. Such probes are therefore particularly suited for powdery bulk material.

The arrangement embodying the invention has the advantage that after the evacuation of air, a protective gas can be introduced. However, one will introduce only a limited amount of protective gas so that the achieved volume reduction is not again reversed. It is also possible, if necessary, to flow protective gas through the entire bulk material so that the volume can be enlarged and subsequently the protective gas is again evacuated. Thus one is assured that the remaining residual gas is not air containing oxygen, but for example nitrogen. The connection to a pressure air source permits a cleaning of the suction probes after one suction operation. The pressure air is only introduced when the probes are exposed, namely the bulk material has been ejected from the fill pipe.

The pressing mechanism permits a further shaping and compacting of the container content and serves to eliminate cavities in the bulk material.

The further development of the invention permits a mounting of a wrapping packing so to speak in a continuous-flow method, that is a closed packing container is placed automatically into a wrapped container so that an inbetween stacking is not needed.

BRIEF DESCRIPTION OF THE DRAWINGS

One exemplary embodiment of the apparatus is schematically illustrated in the drawings, in which:

FIG. 2 is a vertical cross-sectional view which is enlarged compared with FIG. 1 of the fill pipe of the flexible tube bagging machine which is illustrated in FIG. 1 and of elements adjacent to said fill pipe;

FIG. 3 is a cross-sectional view taken along the line III—III of FIG. 2;

FIG. 4 is an illustration corresponding with FIG. 2, wherein other positions of the elements are shown;

DETAILED DESCRIPTION

Figure 1:
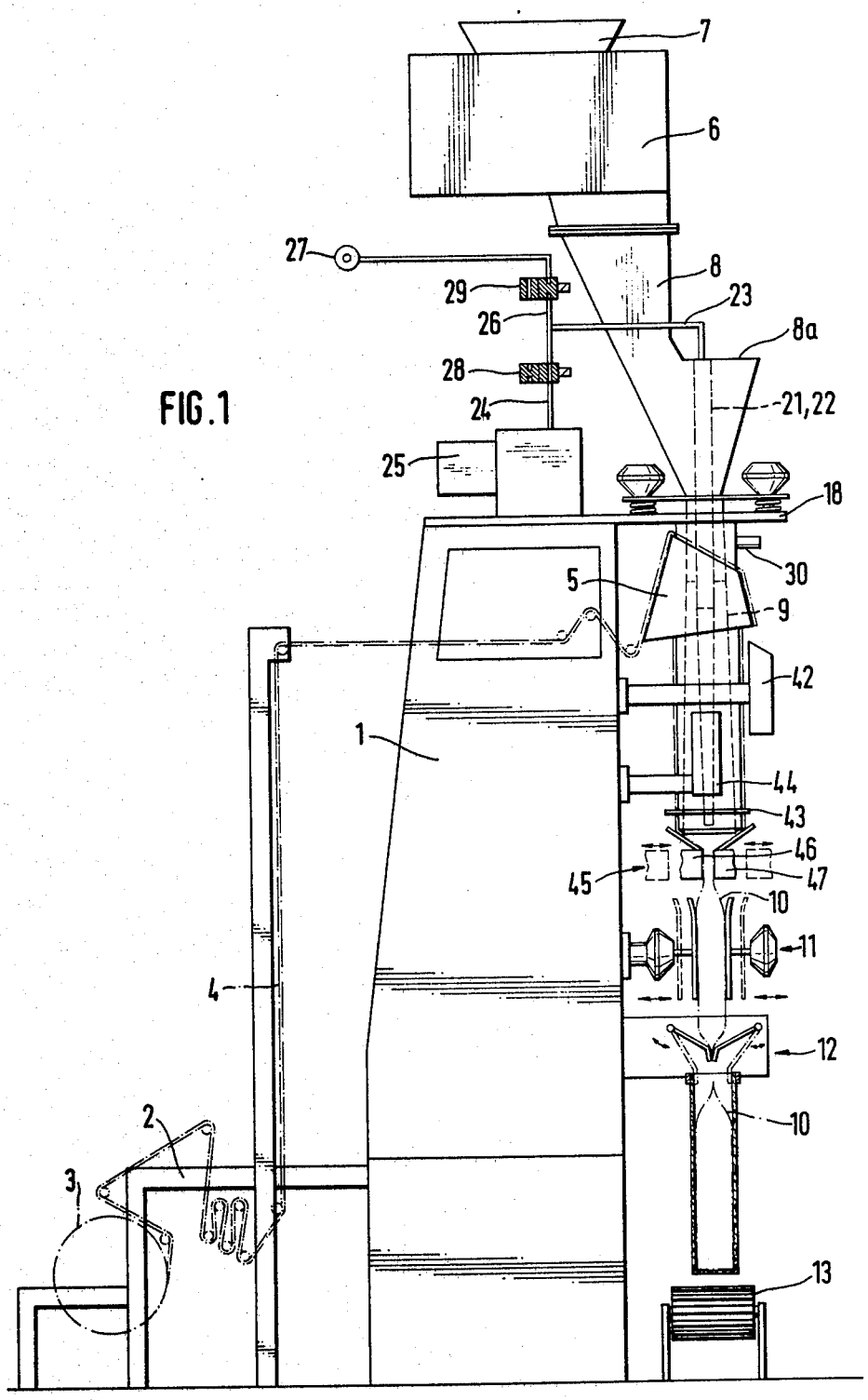
FIG. 1 is the side view of a flexible tube bagging machine, which is equipped with an inventive apparatus.

The flexible tube bagging machine which is illustrated in FIG. 1 has a frame 1 in which are primarily housed the drive elements and control mechanisms of the flexible tube bagging machine. Behind the actual machine frame 1 there is provided an additional frame 2 which supports a casing-material roll 3 from which a casing-material sheet 4 is pulled. The casing-material sheet is guided over several spaced guide rollers in a conventional manner to a shaping shoulder 5 whereat the flat casing-material sheet 4 is formed into a tube.

A material measuring device 6 is mounted onto the machine frame 1 and has a funnel 7 on top thereof for supplying bulk material which is to be packaged. A transfer funnel or chute 8 is connected to the lower end of the material measuring device 6 to guide the bulk material into a vertically aligned fill pipe 9. The bulk material having entrapped air therein in the fill pipe is filled subsequently into a packing container 10 which is constructed as a tube-like bag. The packing container 10 is pressed into a pressing mechanism which as a whole is identified by reference numeral 11 and the thus treated bag is thrown into an overbag in a sacking mechanism 12. A conveyor belt 13 is provided below the sacking mechanism 12 to catch a discharged packing container together with the overbag to guide same away and, for example, into a station for sewing up or sealing the overbag.

The elements of the apparatus which were mentioned in general above are discussed in more detail hereinbelow.

The fill pipe 9 has (see FIG. 3) an approximately rectangular cross section with the long sides 9*a* and the short sides 9*b*. The corners of the pipe are rounded off at relatively large radii. The fill pipe 9 enlarges from the top toward the bottom as can be clearly seen from the drawings. The fill pipe can be moved a small distance in its longitudinal direction. An operating mechanism includes pneumatic cylinders 13,14 the piston rods of which engage a plate 15 which is secured to the outer periphery of the fill pipe 9. Pressure springs 16,17 are supported at the bottom end thereof on a plate 18 and urge the plate 15 and thus the fill pipe 9 upwardly therefrom. The plate 18 is secured to the machine frame 1. The walls of the fill pipe 9 diverge so that the enlarging angle $\alpha$ is approximately 4°.

The transfer funnel 8 extends into the upper end of the fill pipe 9.

The fill pipe 9 is surrounded by an outer pipe 19 which is spaced a small distance from the fill pipe 9 so that a space 20 exists between the pipes 9 and 19. The outer pipe 19 has a constant cross section over the largest portion of its length. It is fixedly connected to the plate 18 and is not movable axially. The outer pipe 19 extends downwardly from the plate 18 and is constructed at its lower end 19*a* according to the desired bag cross section. It is slightly shorter than the inner pipe 9.

Two suction probes 21 and 22 are arranged in the fill pipe 9. Each probe has a lower porous part 22*a* and an upper nonporous part 22*b*. The porous part 22*a* consists advantageously of sintered material. The upper ends of the suction probes are secured to the transfer funnel 8.

The cross sections of the suction probes can be seen from FIG. 3. The cross sections are relatively flat or thin and have approximately the shape of a double-edged sword.

As is shown in FIG. 1, the probes 21,22 project through an upper wall 8*a* of the transfer funnel 8. A conduit 23 is connected to the upper ends and extends to a vacuum pump 25 through a further conduit 24. Furthermore, the conduit 23 is connected through a conduit 26 to a source 27 for protective gas. A valve 28 is installed in the conduit 24 and a valve 29 is installed in the conduit 26.

The space 20 between the fill pipe 9 and the outer pipe 19 is connected by a pipe connection 30 (see FIG. 5) to a not illustrated suction pump.

Figure 5:
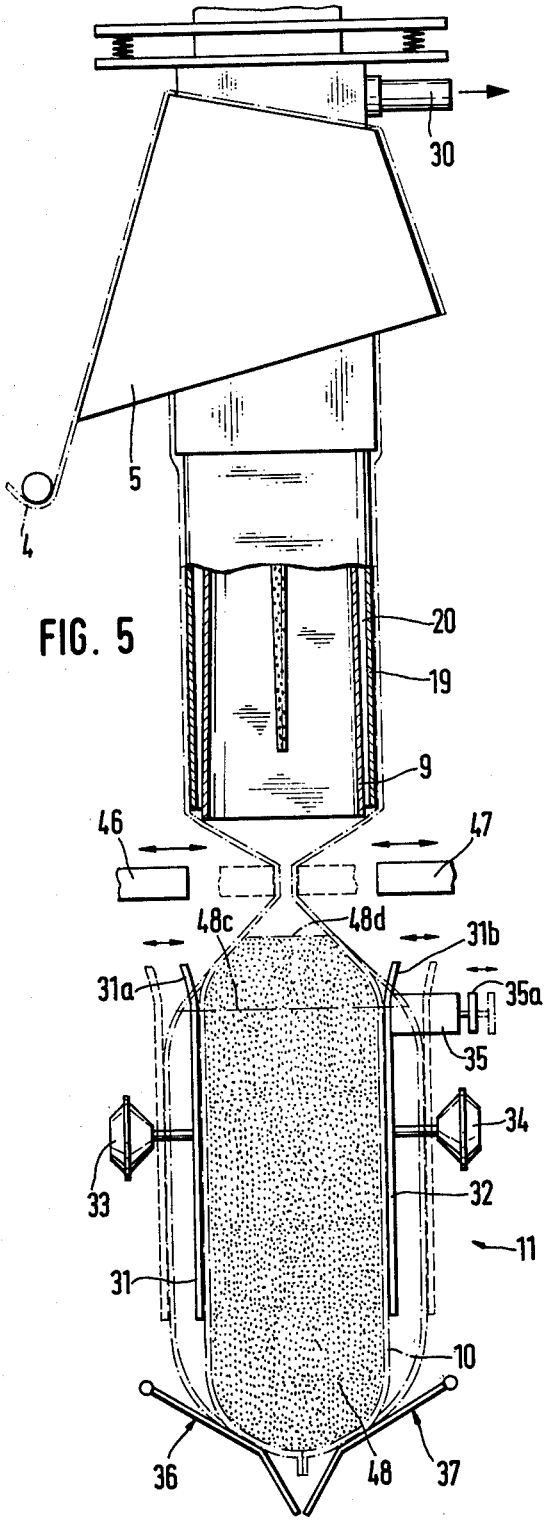
FIG. 5 is a partial front view, a partial vertical cross-sectional view of the portion which is also illustrated in FIGS. 2 and 4 and of a pressing mechanism which is arranged therebelow.

The pressing mechanism which is arranged below the fill pipe will now be examined in connection with FIG. 5. The pressing mechanism 11 has two oppositely positioned pressing plates 31 and 32, the upper ends 31*a* and 31*b* of which are bent so that they diverge upwardly. The pressing plates are parallel to one another and can be moved perpendicularly to their planes by means of pneumatic cylinders 33,34. A vibrator 35 is arranged on the pressing plate 32 and has a back and forth moving mass 35*a*. The vibrator causes a vibration of the plate 32. Two gate members 36 and 37 are provided below the pressing mechanism. The packing container 10 is placed onto the gate members when the gate members are in the position shown in FIG. 5.

The sacking mechanism 12 has a connecting piece 38 over the lower end of which a bag 39 can be moved. The bag will be held to the connecting piece by means of a clamping force between the connecting piece 38 and braces 40,41. The connecting piece 38 has an upper funnel-shaped enlargement 38*a*, which makes sliding of the packing container 10 into the bag 39 easier.

The following elements which up to now had not been mentioned are also part of the flexible tube bagging machine 1.

To produce the so-called longitudinal sealing seam (of course in place of a sealing it is also possible for example to weld or glue; the respective method of connection depends on the material of the casing) by which the overlapping edges of the casing-material sheet 4 are connected, a longitudinal sealing jaw 42 is provided which is movable back and forth in sequence with the stepwise advance of the casing-material sheet 4 to press the casing-material sheet together during welding or sealing.

In the area of the outer pipe 19, there is also arranged an ionizing device 43 for discharging the static electricity of thermoplastic casing material to prevent as much as possible the settling of dust on the casing material.

Casing-material transporting devices 44 are also arranged laterally of the outer pipe 19 and consist in a conventional manner of short conveyor belts which press against the casing material and can be indexed stepwise to cause the casing-material sheet 4 to be pulled downwardly on the outer pipe 19.

Below the fill pipe 9 and the outer pipe 19 there is provided a cross seam station which is identified as a whole by reference numeral 45. The casing-material containers are closed off both at the bottom and on top at this station. The cross seam station 45 has two jaws 46 and 47 which are movable back and forth corresponding with the drawn-in double arrows in FIGS. 1 and 5. Furthermore a separating knife which is not shown is arranged in the cross seam station and causes a separation between the filled and closed packing containers.

The apparatus operates as follows:

A certain portion of the bulk material is measured in the material measuring device 6, namely a portion which is sufficient to fill a packing container 10. This portion is filled through the transfer funnel into the fill pipe 9. The fill pipe 9 is closed off at this stage and at the bottom thereof by a bag sealed only at the bottom and the sloped elastic surfaces 46*a*,47*a* which are provided on the jaws 46,47. This bag is produced as follows.

The casing-material sheet 4 is pulled over the shaping shoulder 5 which surrounds the outer pipe 19, namely with the aid of the casing-material conveyor belts 44. The first flat casing-material sheet is thereby shaped into a tube and the foil edges overlap. The overlapping edges were welded together with the longitudinal sealing jaw 42 so that in the area below the longitudinal sealing jaw 42 there is provided an all around closed tube. This tube is pressed together by the jaws 46 and 47 which also forms a bottom seam for the bag to be filled. The jaws 46 and 47 have the already mentioned sloped contact surfaces 46*a* and 47*a*, on which rests the tubular casing-material and thus forms a bottom support.

The level of the bulk material 48 (see FIG. 2) is first up to the level indicated by the dash-dotted line 48*a*. The porous parts of the suction probes 21 and 22 are completely covered by the bulk material 48. Now the valve 28 is opened by means of an automatically operating control device so that air is sucked from the probes 21,22 through the conduits 23,24. The air is thereby pulled from the spaces between the particles of the fill material 48 and passes through the porous surfaces of the probes to the interior thereof and through the conduits 23,24 and the vacuum pump 25 finally to the outside.

After the evacuation of entrapped air from the bulk material, the level will have dropped to the level 48*b*, namely the volume of the bulk material is substantially reduced. If desired, it is now possible to introduce by opening of the valve 29 protective gas, for example carbon dioxide, into the bulk material 48 while simultaneously avoiding an enlargement of the volume of the bulk material.

The jaws 46,47 are now driven apart. The compacted bulk material 48 is discharged from the fill pipe 9 and this is done in the following manner. The fill pipe 9 is moved downwardly with the aid of the pneumatic cylinder 13,14 so that the fill pipe 9 will reach the position illustrated by dashes in FIG. 4. This lowermost position is limited by a stop 78*a*. Upon hitting this stop, an impact or shock is created and the fill pipe 9 is suddenly stopped. The momentum of the bulk material 48 has the tendency to maintain its downward movement and is thereby torn out of or released from the fill pipe 9. This tearing loose is made easier by the enlargement of the fill pipe and the tapered portion of the probes 21,22. Simultaneously with this operation, the casing sheet is again indexed and moved with the aid of the feed belts 44 so that the tube is moved through between the jaws 46,47, which piece of tube is closed at the bottom by a bottom seam and is filled with compacted bulk material 48. The filled piece of tube is moved downwardly until it is between the pressing plates 31,32 (position according to FIG. 5).

Figure 6:
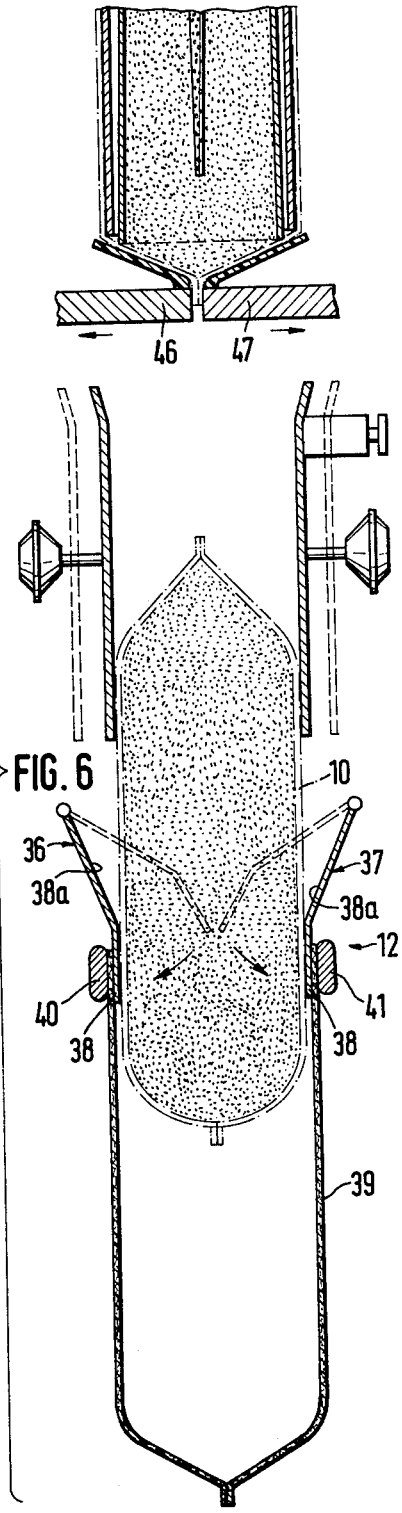
FIG. 6 illustrates the lower end of the fill pipe and adjacent elements and the pressing mechanism arranged therebelow and a device arranged therebelow for holding an overbag.

The jaws 46,47 thereafter approach one another again, however, they are not entirely pressed together. They first reach the position illustrated by dashed lines in FIG. 5. The pressing plates 31,32 are moved from the outer positions illustrated in dashed lines into the positions illustrated with solid lines and this advance is done by the pneumatic cylinders 33,34. During this pressing operation, any cavities in the bulk material are compressed, which cavities are generally created during the pulling out or removal of the probes 21,22 from the bulk material. Simultaneously therewith, air is evacuated through the connection 30, which air was still in the upper part of the bag. Prior to the pressing operation, the bulk material has assumed the level 48*c*, while after the pressing operation, the level 48*d* exists. After the second evacuation operation, the jaws 46,47 are closed completely so that both a head seam for the bag 10 which is in the pressing mechanism and also a bottom seam for the bag which must be next produced is formed. The not shown separating knife effects a cut between the seam places and causes the finished lower bag to be separated. It is first still held by the clamping action of the jaws 46,47. When these jaws are moved away from one another, the finished bag 10 will fall downwardly after the two gate members 36,37 are tilted downwardly corresponding with the arrows illustrated in FIG. 6.

The bag 10 falls now into the overbag 39. After the bag 10 has been received there, the clamping jaws 40,41 are released after which the overbag together with bag 10 arrives on the conveyor belt 13 (see FIG. 1) and is moved for example to a sewing station, in which the upper end of the overbag 39 is sewn shut.

After one bag is closed, pressurized air is blown into the probes to clean same, which air blows out bulk material which penetrated the probe surfaces and remained in the pores.

The jaws 46 and 47 hold the bag which must be next produced in closed condition and the entire described sequence starts over again.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for packaging of powdery bulk materials, comprising:

a flexible tube bag forming machine having a generally vertically aligned hollow fill pipe means thereon around which is formed a flexible tube container;

cross sealing jaw means located below the lower end of said hollow pipe means and movable laterally back and forth for periodically closing and sealing the lower end of the material forming said flexible tube container;

bulk material measuring and dispensing means for measuring and dispensing of bulk material portions, said dispensed bulk material portion being received in said fill pipe means only after said cross sealing jaw means has closed and sealed said lower end of said flexible tube container;

suction means for evacuating gas contained in said bulk material portion in said fill pipe means, said suction means comprising at least one suction probe having suction openings over the outer surface thereof, said suction probe being arranged in the interior of said fill pipe means; and expelling means for simultaneously expelling said bulk material portion from said fill pipe means into said flexible tube container and effecting the removal of said flexible tube container from said lower end of said fill pipe means.

2. The apparatus according to claim 1, wherein said suction probe is constructed flat and has a flat-rhombic cross section.

3. The apparatus according to claim 1, wherein said suction probe is convergingly tapered in direction of movement of said bulk material portion.

4. The apparatus according to claim 1, including plural suction probes which are arranged spaced from one another in said fill pipe means.

5. The apparatus according to claim 1, wherein said suction probe consists in a conventional manner of metal particles which are sintered together.

6. The apparatus according to claim 1, wherein said suction means includes two conduits openable and closeable by valve means connected to said suction probe, one conduit being connected to a suction pump and the other being connected to a source of protective gas or pressure air.

7. The apparatus according to claim 1, wherein below said fill pipe means there is arranged a pressing mechanism for flat pressing of packing containers which are constructed as bags.

8. The apparatus according to claim 7, wherein said pressing mechanism has two parallel pressing plates arranged parallel with respect to the longitudinal axis of said suction probe.

9. The apparatus according to claim 7, wherein a vibrator is arranged on said pressing mechanism.

10. The apparatus according to claim 1, wherein below said fill pipe means there is arranged a holding mechanism for an overbag into which said flexible tube container can fall.

11. The apparatus according to claim 10, wherein for opening and holding of said overbag said holding mechanism has an expanding mechanism and a clamping mechanism for the upper edge of said overbag.

12. The apparatus according to claim 1, wherein said expelling means includes support means for supporting said fill pipe means for longitudinal movement for effecting said expelling of said bulk material portion therefrom.

13. The apparatus according to claim 12, wherein said support means includes stop means located at the end of the path of movement of said fill pipe means so that the forward movement of said fill pipe means can be suddenly stopped and the momentum of said bulk material portion will cause said expelling of said bulk material portion.

14. The apparatus according to claim 1, wherein said fill pipe means includes both a hollow fill pipe and an outer pipe, said outer pipe surrounding said fill pipe and being coextensive therewith, wherein between said fill pipe and said outer pipe there is provided a space which is open at an end of said fill pipe and to which is connected an additional suction device for evacuating gas contained within said space.

15. The apparatus according to claim 14, wherein said fill pipe is enlarged toward its lower end, wherein the enlarging angle ($\alpha$) lies in the range of between 2° and 6°.

16. The apparatus according to claim 14, wherein the fill pipe has an approximately rectangular cross section.

17. The apparatus according to claim 14, wherein the inside cross section of the said fill pipe is approximately equal to the cross section of said flexible tube container.

18. The apparatus according to claim 14, wherein said outer pipe has a shaping shoulder thereon for forming said flexible tube container.

* * * * *